US005486972A

United States Patent [19]

Taylor

[11] Patent Number: 5,486,972

[45] Date of Patent: Jan. 23, 1996

[54] AC POWERED ELECTRICAL CONTROL DEVICE WITH LOGIC LEVEL CONTROL

[75] Inventor: Glen D. Taylor, Fayetteville, N.C.

[73] Assignee: Eaton Corporation, Cleveland, Ohio

[21] Appl. No.: 176,151

[22] Filed: Dec. 30, 1993

[51] Int. Cl.[6] ..... H01H 47/32; H01H 50/04; H01H 45/12

[52] U.S. Cl. ..... 361/154; 361/170; 361/205; 361/142; 361/703

[58] Field of Search ..... 361/152, 153, 361/154, 155, 160, 170, 173, 175, 187, 186, 205, 701–703, 142; 307/130, 117; 327/438, 439

[56] References Cited

U.S. PATENT DOCUMENTS

| | | | |
|---|---|---|---|
| 3,453,450 | 7/1969 | Evalds | 327/419 |
| 3,821,671 | 6/1974 | Grunert et al. | 335/132 |
| 4,158,150 | 6/1979 | Dever | 323/18 X |
| 4,281,359 | 7/1981 | Bayer et al. | 361/115 |
| 4,309,683 | 1/1982 | Grunert et al. | 335/132 |
| 4,470,092 | 9/1984 | Lombardi | 361/23 |
| 4,630,166 | 12/1986 | D'Onofrio | 361/205 |
| 4,706,158 | 11/1987 | Todara et al. | 361/92 |
| 4,745,311 | 5/1988 | Iwasaki | 327/428 |
| 4,833,565 | 5/1989 | Bauer et al. | 361/154 |
| 4,864,457 | 9/1989 | Christian et al. | 361/153 |
| 4,890,184 | 12/1989 | Russell | 361/87 |

OTHER PUBLICATIONS

General Electric—Silicon Controlled Rectifier Manual, Third Edition, pp. 103–104, 269–271, 279–287, TK279864g, 1964 c. 3, published prior to Sep. 14, 1965.

*Primary Examiner*—A. D. Pellinen
*Assistant Examiner*—Fritz M. Fleming
*Attorney, Agent, or Firm*—Martin J. Moran

[57] ABSTRACT

The coil of an electric control device is energized by ac power controlled by a remotely generated logic level signal through a control module mounted in a cavity in the exterior of the device housing. The module contains a pair of back-to-back silicon controlled rectifiers (SCRs) mounted on a finned aluminum wall of the module which serves as a heat sink. An opto-coupler comprising a light emitting diode (LED) energized by the logic level signal and an opto-triac in series with resistors connected across the gates and cathodes of the back-to-back SCRs provides electrically isolated control of the conduction angles of the SCRs by the logic level signal.

13 Claims, 3 Drawing Sheets

AC POWERED ELECTRICAL CONTROL DEVICE WITH LOGIC LEVEL CONTROL

BACKGROUND OF INVENTION

1. Field of the Invention

This invention relates to ac power switching devices having operating coils powered by ac current, and more particularly to such devices in which power to the operating coil is controlled by logic level signals.

2. Background Information

Many electric switching devices such as contactors and motor starters have an operating coil energized by ac power. This ac power may be 120 volts or the line voltage of the circuit being controlled which may be, for example, up to 600 volts or even more. Conventionally, the control circuits for the coils have also operated at 120 volts or at the line voltage. Such control circuits have included several conductors operating at these voltages and extending between the operating coil on the contactor or starter and a control panel. Adequate protection must be provided for all components to which such voltages are applied. In addition, especially in the instances where line voltages above 120 volts are present, workers trained in handling such voltages are required for installation and service of the devices.

Recently, programmable logic controllers (PLC) have been developed for controlling contacts and starters. These controllers utilize logic level signals (typically 0–5 volts) to switch 120 volts and are implemented on printed circuit boards. Hence, lines carrying 120 volts are required between the printed circuit boards and the contactors and starters, and the boards must be designed to handle the power drawn by the contactor or starter coil. These PLCs use pulse width modulated logic signals to control the firing angles of solid state switching devices which gate half cycles of the 120 volt ac current to the coil. For instance, full conduction is used to initiate closure of the contacts of the device and then conduction is scaled back to provide the reduced level of holding current needed once the contacts are closed.

The PLCs provide the capability of controlling the contactors and starters remotely, such as, by a computer which may coordinate the operation of a large number of such devices through a communications network.

Many of the existing contactors and starters, such as, for example, those disclosed in U.S. Pat. Nos. 3,821,671 and 4,309,683 are enclosed within the interior of an insulating housing. The housings have exterior recesses, or cavities, in which auxiliary contact devices are mounted. These auxiliary contacts may be used, for example, to provide an electrical interlock for the device.

There is a need for remotely controlling the large number of power level controlled contactors and starters in service.

There is a further need for remotely controlling such devices without the need for extended lengths of power leads between the devices and control circuits.

There is an additional need for apparatus for easily and economically retrofitting existing devices.

SUMMARY OF THE INVENTION

These and other needs are satisfied by the invention which is directed to electric control devices in which ac power for the operating coil is controlled by logic level signals through a control module removably mounted in a cavity defined by the exterior surface of the device housing. Ac power switches in the form of back-to-back SCRs are bonded to a finned metal wall of the module which serves as a heat sink. A control circuit for SCRs includes gate to anode resistors connected in series with a bi-directional switch. The logic level signal controls conduction by the bi-directional switch to regulate current through the resistors, and therefore, control the conduction angles of the SCRs. The bi-directional switch is electrically isolated from the logic level signal. Preferably, the bi-directional switch is an opto-triac which forms an opto-coupler with an LED energized by the logic level signal. The logic level signal may be either an analog or digital signal generated by a PLC, which can be located outside the device housing and the control module.

The invention provides the capability of controlling new and existing contactors and starters remotely with low voltage dc logic level signals, and without the need for a PLC to handle potentially dangerous power level signals or the need for numerous power level leads extending from the contactor or starter to a control panel.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
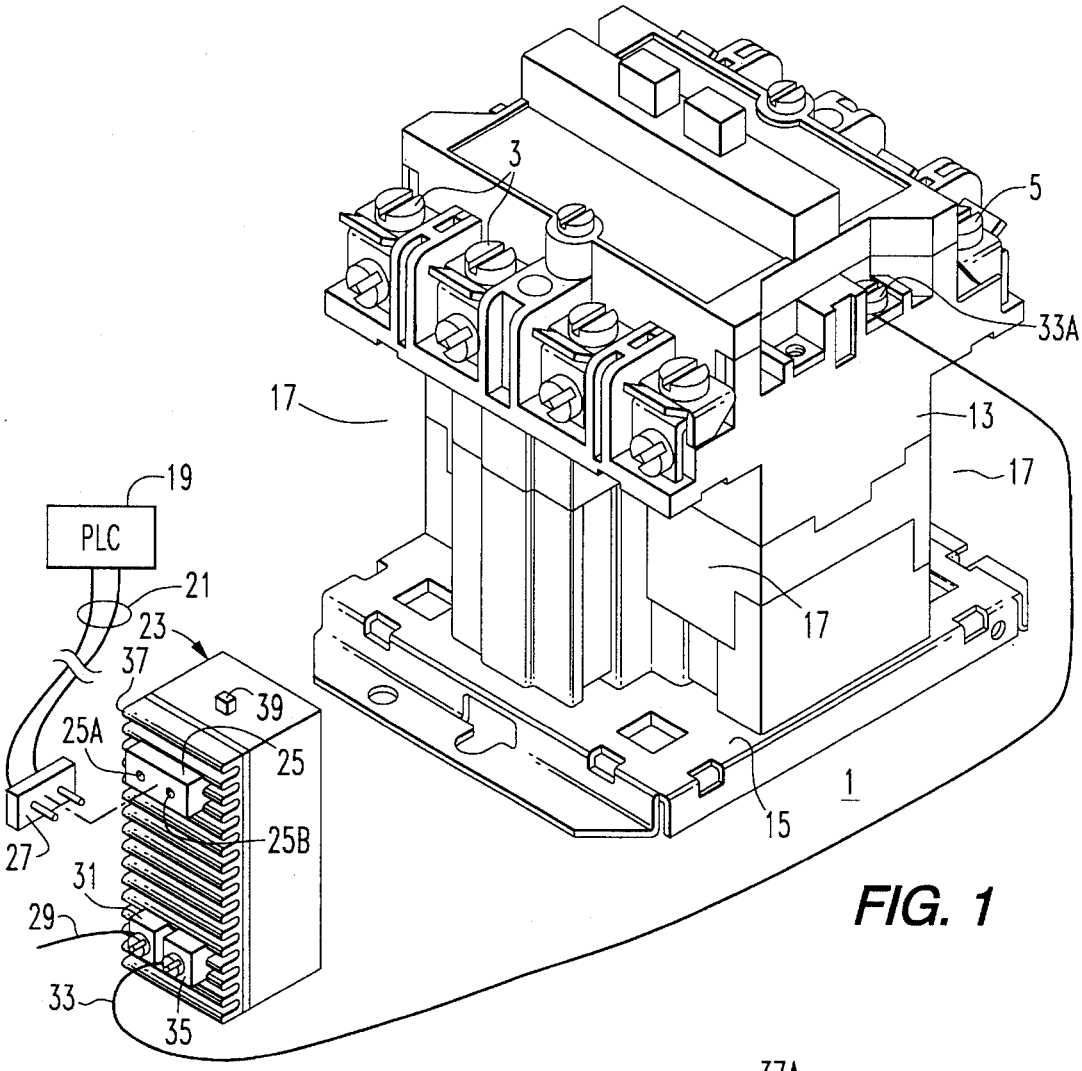
FIG. 1 is an exploded isometric view of an electric control device incorporating the invention.

FIG. 1 illustrates an electric control device 1 such as a contactor or motor starter. The device 1 may be of the type disclosed in U.S. Pat. No. 3,821,671 which is herein incorporated by reference. This device 1 switches power supplied by a three phase electrical system with a neutral applied to line terminals 3 to a load device (not shown) such as a motor etc., connected to load terminals 5. As illustrated schematically in FIG. 3, the device 1 includes pairs of separable electrical contacts for each phase and the neutral conductor (only one phase shown). The contacts 7 are opened and closed by an armature 9 which is actuated by an electromagnet including a coil 11.

Returning to FIG. 1, the separable contacts, armature, coil and other operating components of the device 1 are mounted inside an electrically insulating housing 13. The electrically insulating housing is mounted on a metal base plate 15. Recesses, or cavities, 17 are formed in the corners of the exterior surface of the insulating housing 13. Commonly, electrical interlock devices have been mounted in these cavities.

Conventionally, the coil 11 is operated by 120 volts, or the line voltage, which has been controlled from a control panel remote from the device 1. This arrangement has required several lines at this voltage between the contactor and the control panel. Recently, control panels have incorporated programmable logic circuits (PLCs) 19 for switching power for the coil. These installations still require power level signals of 120 volts or more between the PLC and the electric control device 1. In accordance with the invention and in contrast with prior practice, the PLC 19 switches analog logic level signals which are transmitted to the electric control device 1 through a single two-lead conductor 21. The logic level signals preferably have ranges from 0–5 volts dc to 0–30 volts dc.

The device 1, in accordance with the invention, includes a control module 23 which is mounted in one of the cavities 17 exterior of the housing 13 of the contactor 1. This control module 23 includes a two pin connector 25 to which mating connector 27 on the cable 21 from the PLC 19 is connected to supply the logic level signals to the module 23. Two pin connecter 25 has pins 25A and 25B. A 120 volt ac supply lead 29 is connected to a first power terminal 31 on the module. A second 120 volt lead 33 is connected between a second power terminal 35 on the module 23 and the coil 11. One wall 37 of the module 23, which faces outward when the module is installed in the cavity 17 in the device 1, is a finned aluminum heat sink which radiates heat generated by power switching devices mounted to the inside surface 37A of the wall 37.

Figure 2:
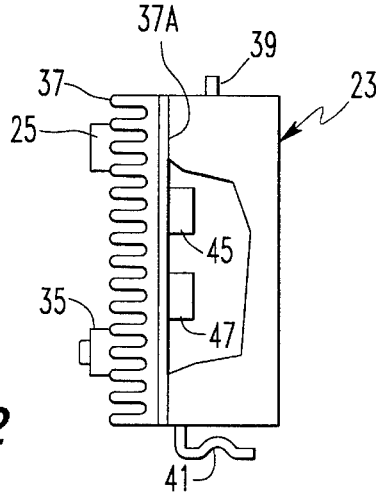
FIG. 2 is a side elevation view with parts broken apart of a control module which forms a part of the control device of FIG. 1.

The control module 23 is retained in the cavity 17 by a clip 39 on the top which engages a slot in the cavity 17 (not shown) and a spring clip 41 on the bottom (see FIG. 2).

Figure 3:
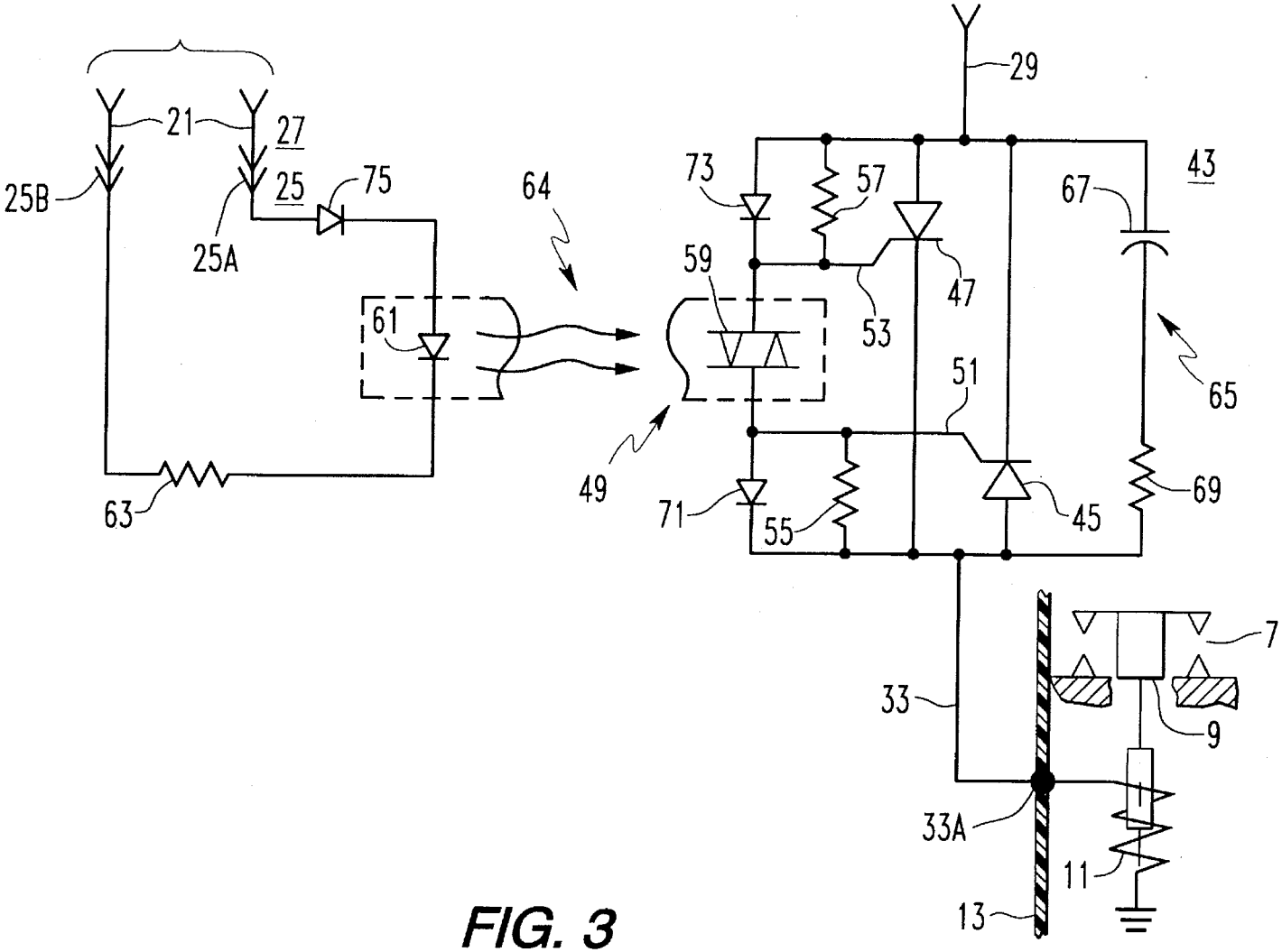
FIG. 3 is a schematic circuit diagram of the control module of FIG. 2 shown connected to the coil of the electric control device of FIG. 1.

FIG. 3 illustrates the control circuit contained in the control module 23. This control circuit 43 includes power switching means in the form of a pair of back-to-back silicon controlled rectifiers (SCRs) 45 and 47 each connected in series with the supply lead 29 and lead 33 connected to the coil 11 and each mounted on the inside surface 37A of the wall 37. A control circuit 49 is connected to the gate electrodes 51 and 53 of the SCRs 45 and 47, respectively. The gate control circuit 49 includes a first resistor 55 connected across the gate electrode 51 and the anode of the SCR 45 and a second resistor 57 connected between the gate electrode 53 and the anode of the SCR 47. The resistors 55 and 57 are connected in series with the bi-directional switch 59. A preferred form of the switch 59 is an opto-triac. The logic level signal from the PLC 19 provided on the leads 21 energizes a light emitting diode (LED) 61 which is in series with a current limiting resistor 63. The opto-triac 59 and the LED 61 form an opto-coupler 64 which electrically isolates the logic level signal from the power circuit. A snubber circuit 65 formed by the series connected capacitor 67 and resistor 69 is connected across the back-to-back SCRs 45 and 47. This snubber circuit prevents inadvertent turn-on of the SCRs. Diode 71 in series with resistor 73 and diode 75 in series with resistor 77 protect the gates of the SCRs 45 and 47, respectively, and diode 79 assures that only dc signals are applied to LED 61.

The logic level signal in this circuit is a 0–5 volt analog signal, however, other analog logic level voltage ranges can be used, such as 0–30 volt dc. The LED 61 emits radiant energy of a magnitude proportional to the magnitude of the analog signal. Radiant energy emitted by the LED 61 turns on the opto-triac 59 causing current to flow in the resistors 55 and 57. The magnitude of this current, and therefore, the voltage applied to the gate electrodes 51 and 53 is proportional to the magnitude of the analog signal. The SCRs 45 and 47 fire when their respective gate voltages reach the breakdown voltage of the device. With a full scale analog logic level signal (5 volts dc in this embodiment), the opto-triac 59 is turned full on and the SCRs fire immediately on alternate half cycles of the ac voltage for 100% conduction. For lower magnitudes of the analog signal, reduced current flows through the resistors 55 and 57 so that the ac voltage must reach a higher magnitude before the SCRs fire. Thus, the conduction angles of the SCRs 45 and 47 are phased back as the magnitude of the analog signals is reduced.

Figure 4:
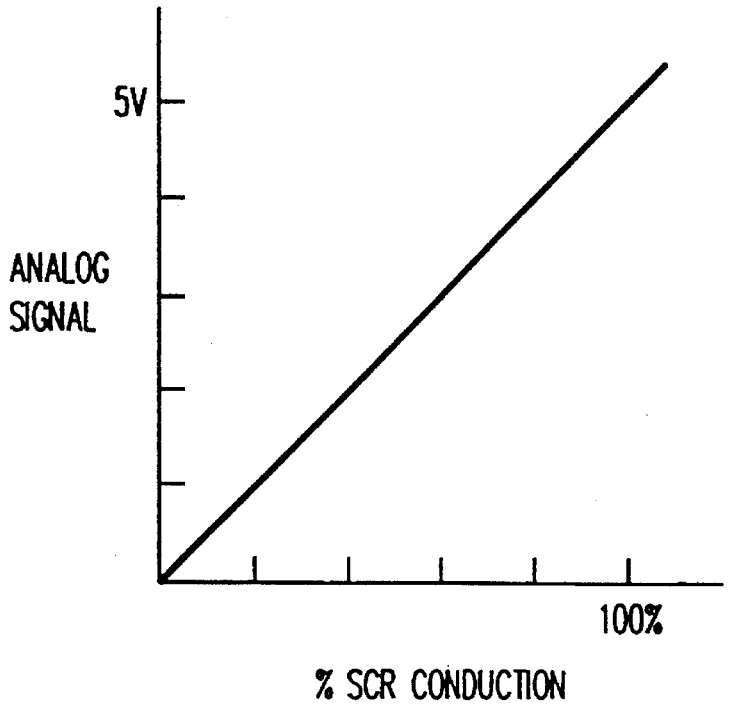
FIG. 4 is a plot of the logic level signal and the coil voltage signal for the electric control device of FIG. 1 as controlled by the control circuit of FIG. 3.
Figure 5:
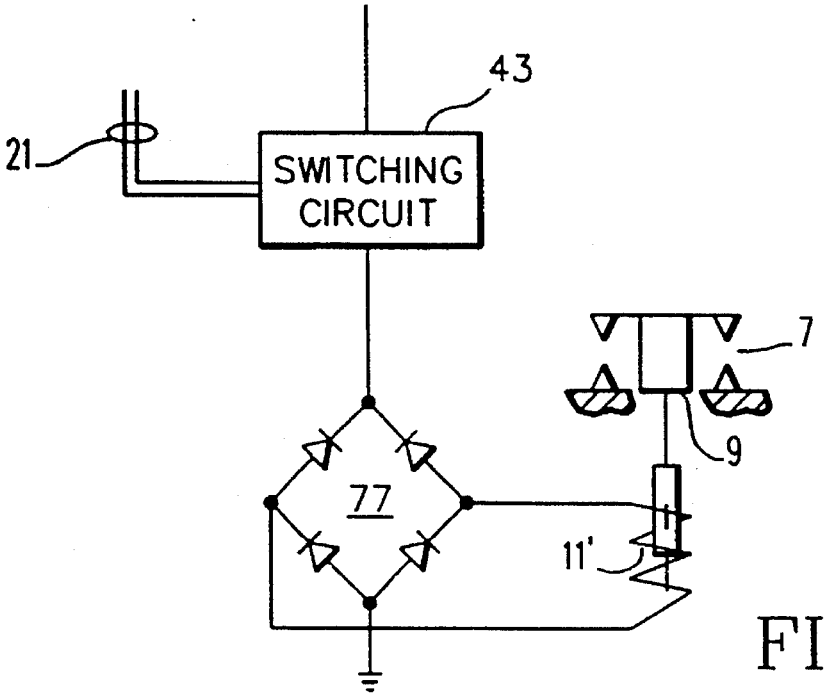
FIG. 5 illustrates a modification to the circuit of FIG. 3 for use with the electric control device of FIG. 1 having a dc coil.

FIG. 4 illustrates that the conduction angle of the SCRs 45 and 47 are linear functions of the magnitude of the analog logic level signal. The SCRs 45 and 47 are naturally commutated off at the end of the respective half cycles of the ac voltage. FIG. 5 illustrates the circuit diagram for an ac coil 11 in the contactor 1. Alternatively, the contactor coil can be a dc coil. Thus, as illustrated in FIG. 5, the dc coil 11 is connected to the dc terminals of a full wave bridge circuit 81 which is energized by the solid state switching circuit 43.

With the invention, the control scheme of the new microprocessor-based contactors and motor starters can be applied to the many existing analog contactors and starters in the field. These control schemes include variable control of current supplied to the armature coil and reduction of coil heat generation. Furthermore, the schemes for controlling contact bounce could also be applied to extend the life of the electric control device. While in the exemplary device, the logic level signal has been described as an analog logic signal, a digital signal, such as pulse width modulated digital signal synchronized to the line voltage, could be generated by the PLC to control energization of the armature coil using the present invention.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

I claim:

1. An electric power switching device operated by ac power and comprising:

an insulated housing including an exterior surface defining a cavity that is exterior of said housing; separable electrical contacts within said housing; electromagnetic means within said housing including a coil energized by said ac power to move said separable contacts between open and closed positions; a control module mounted in said cavity comprising solid state switching means responsive to an externally generated logic level signal for selectively connecting said coil to said ac power receiving means for receiving said logic level signal operatively connected to said solid state switching means.

2. The device of claim 1, wherein the logic level signal is an analog signal having an amplitude that is continuously variable within a predetermined range.

3. The device of claim 2, wherein said solid state switching means comprises power switching means connecting said ac power to said coil and having gate electrode means, gate control means connected to said gate electrode means and said ac power, said gate control means being responsive to said logic level signal to turn on said power switching means at a point in a cycle of said ac power determined by said amplitude of said logic level signal.

4. The device of claim 3, wherein said control module includes a metal wall having a finned outer surface which dissipates heat and faces outward when said control module is mounted in said cavity, and having an inner surface on which said power switching means is mounted.

5. The device of claim 3 wherein said gate control means includes isolating means electrically isolating said logic level signal from said ac power.

6. The device of claim 3, wherein said power switching means comprises first and second back-to-back SCRs each connected in series with the other and with said ac power and said coil, said first SCR being connected to said coil and said second SCR being connected to said ac power, each SCR having a gate electrode, and wherein said gate control means comprises a first resistor connected between a gate electrode of said first of said back-to-back SCRs and the anode of said first of said back-to-back SCRs, a second resistor connected between a gate electrode of the second of said back-to-back SCRs and the anode of said second of said back-to-back SCRs, and a bi-directional switch connected in series with said first and second resistors between said ac power and said coil and responsive to said logic level signal to control ac current through said first and second SCRs at conduction angles determined by said amplitude of said logic level signal.

7. The device of claim 6, wherein said bi-directional switch comprises an opto-triac connected in series with said first and second resistors and an LED energized by said logic level signal to emit optical energy which controls conduction by said opto-triac.

8. The device of claim 7, wherein said gate control means includes a resistor connected in series between a cathode of the LED and a first logic level signal input terminal externally mounted on said control module, and a diode connected in series between the anode of the LED and a second logic level signal input terminal externally mounted on said control module.

9. The device of claim 6 including snubber means connected across said first and second back-to-back SCRs for preventing inadvertent turn-on of said first and second back-to-back SCRs.

10. The device of claim 9, wherein said snubber means comprises a resistor and a capacitor connected in series across said first and second back-to-back SCRs.

11. The device of claim 6, wherein said control module includes a wall having a finned outer surface which dissipates heat and an inner surface on which said first and second SCRs are mounted.

12. An electric power switching device operated by ac power and comprising: separable electrical contacts; electromagnetic means including a coil energized by said ac power to move said separable contacts between open and closed positions; first and second back-to-back SCRs connecting said ac power to said coil, said first SCR being connected to said coil and said second SCR being connected to said ac power, said SCRs each having a gate electrode, a first resistor connected between a gate electrode of said first SCR and said anode of said first SCR, a second resistor connected between a gate electrode of said second SCR and said anode of said second SCR, a bi-directional switch connected in series with said first and second resistors between said ac power and said coil and responsive to an analog logic level signal having an amplitude continuously variable in a predetermined range to control ac current through said first and second resistors to control firing of said first and second SCRs at conduction angles determined by said amplitude of said logic level signal, and means for receiving said logic level signal operatively connected to said bi-directional switch.

13. The device of claim 12 wherein said bi-directional switch includes an opto-triac connected in series with said first and second resistors and wherein said means for receiving said logic level signal is operatively connected to said bi-directional switch by an LED energized by said logic level signal to emit optical energy which controls conduction by said opto-triac.

* * * * *